US006779341B2

(12) United States Patent
Luo

(10) Patent No.: US 6,779,341 B2
(45) Date of Patent: Aug. 24, 2004

(54) METHOD AND APPARATUS FOR GENERATING KINETIC ENERGY FROM THERMAL ENERGY

(76) Inventor: Chin-Kuang Luo, 5F, No. 56, Min-Chuan Rd., Chung Dist., Taichung City (TW)

( * ) Notice: Subject to any disclaimer, the term of this patent is extended or adjusted under 35 U.S.C. 154(b) by 0 days.

(21) Appl. No.: 10/315,798

(22) Filed: Dec. 9, 2002

(65) Prior Publication Data

US 2003/0233826 A1 Dec. 25, 2003

(30) Foreign Application Priority Data

Jun. 19, 2002 (TW) ..... 91113382 A

(51) Int. Cl.[7] ..... F01B 29/10
(52) U.S. Cl. ..... 60/525; 60/517
(58) Field of Search ..... 60/517, 525

(56) References Cited

U.S. PATENT DOCUMENTS 1,614,962 A * 1/1927 Koenig ..... 60/525
3,807,176 A * 4/1974 Hakansson ..... 60/525
4,107,925 A * 8/1978 Watson ..... 60/521
4,199,945 A * 4/1980 Finkelstein ..... 60/520
5,077,976 A * 1/1992 Pusic et al. ..... 60/525
5,735,123 A * 4/1998 Ehrig ..... 60/525
6,301,893 B1 10/2001 Luo ..... 60/641.1

* cited by examiner

*Primary Examiner*—Hoang Nguyen
(74) *Attorney, Agent, or Firm*—Trop, Pruner & Hu, P.C.

(57) ABSTRACT

In a method and apparatus for generating kinetic energy, thermal energy is applied to a cylinder body of a first pneumatic cylinder to result in an expansion stroke of the first pneumatic cylinder and in rotation of a flywheel assembly that is coupled to the first pneumatic cylinder. A second pneumatic cylinder is coupled to the flywheel assembly such that the expansion stroke of the first pneumatic cylinder results in a compression stroke of the second pneumatic cylinder. The first and second pneumatic cylinders are fluidly intercommunicated when the first pneumatic cylinder reaches the end of the expansion stroke, thereby reducing the temperature of working gas in the first pneumatic cylinder and increasing the temperature of working gas in the second pneumatic cylinder to result in an expansion stroke of the second pneumatic cylinder, continued rotation of the flywheel assembly, and in a compression stroke of the first pneumatic cylinder.

10 Claims, 9 Drawing Sheets

METHOD AND APPARATUS FOR GENERATING KINETIC ENERGY FROM THERMAL ENERGY

CROSS-REFERENCE TO RELATED APPLICATION

This application claims priority of Taiwanese application no. 091113382, filed on Jun. 19, 2002.

BACKGROUND OF THE INVENTION

1. Field of the Invention

The invention relates to a method and apparatus for generating kinetic energy, more particularly to a method and apparatus for generating kinetic energy from thermal energy.

2. Description of the Related Art

Steam engines and combustion engines are widely used for generating kinetic energy. They either use coal or gasoline, which result in air pollution problems and face short supply problems in the near future. In this aspect, natural heat energy, such as solar energy or geothermal energy, is a better resource.

U.S. Pat. No. 6,301,893 discloses the use of natural heat energy for heating water held in a tank of a steam boiler. Steam from the steam boiler is supplied to a steam turbine to produce a mechanical rotary motion that is converted into electrical energy by an electric power generator.

SUMMARY OF THE INVENTION

The object of the present invention is to provide a method and apparatus for generating kinetic energy from thermal energy without using steam boilers and steam turbines.

According to one aspect of the present invention, there is provided a method for generating kinetic energy from thermal energy. The method comprises the steps of:

applying thermal energy to a cylinder body of a first pneumatic cylinder to result in an expansion stroke of the first pneumatic cylinder and in rotation of a flywheel assembly that is coupled to the first pneumatic cylinder;

coupling a second pneumatic cylinder to the flywheel assembly such that the expansion stroke of the first pneumatic cylinder results in a compression stroke of the second pneumatic cylinder; and fluidly intercommunicating the first and second pneumatic cylinders at the instant the first pneumatic cylinder reaches the end of the expansion stroke, thereby reducing the temperature of working gas in the first pneumatic cylinder and increasing the temperature of working gas in the second pneumatic cylinder to result in an expansion stroke of the second pneumatic cylinder, continued rotation of the flywheel assembly, and in a compression stroke of the first pneumatic cylinder.

According to another aspect of the present invention, there is provided an apparatus for generating kinetic energy from thermal energy. The apparatus comprises a thermal energy source, first and second pneumatic cylinders, a fluid pipe, and a flywheel assembly.

The first pneumatic cylinder includes a first cylinder body having a heating section to be heated by the thermal energy source, and an operating section opposite to the heating section and formed with a first radial hole. The first piston is disposed in the first cylinder body, and cooperates with the heating section of the first cylinder body to form a first chamber that is filled with a working gas. The first piston is movable along the length of the first cylinder body. A first piston rod is connected to the first piston, and extends out of the first cylinder body through the operating section. The first piston seals the first radial hole during a compression stroke of the first pneumatic cylinder, and unseals the first radial hole at the end of an expansion stroke of the first pneumatic cylinder.

The second pneumatic cylinder includes a second cylinder body parallel to the first cylinder body. The second cylinder body has a chamber-connecting section formed with a second radial hole, and an operating section opposite to the chamber-connecting section. A second piston is disposed in the second cylinder body, and cooperates with the chamber-connecting section to form a second chamber that is filled with the working gas. The second piston is movable along the length of the second cylinder body.

The fluid pipe has opposite ends connected to the first and second cylinder bodies at the first and second radial holes, respectively.

The flywheel assembly includes a transmission axle having a first axle end and a second axle end. A first flywheel is secured on the first axle end. A first connecting rod has a first end pivoted eccentrically on the first flywheel at a first pivot point, and a second end connected pivotally to the first piston rod. A second flywheel is secured on the second axle end. A second connecting rod has a first end pivoted eccentrically on the second flywheel at a second pivot point that is spaced apart angularly from the first pivot point with respect to the transmission axle, and a second end connected pivotally to the second piston and extendible into and out of the second cylinder body through the operating section of the second cylinder body and in a same direction as the first piston rod and the first connecting rod.

The thermal energy applied by the thermal energy source to the heating section of the first cylinder body initially results in the expansion stroke of the first pneumatic cylinder, thereby resulting in rotation of the first flywheel and the transmission axle, and in rotation of the second flywheel to result in a compression stroke of the second pneumatic cylinder.

When the first piston reaches the end of the expansion stroke of the first pneumatic cylinder, the first and second chambers are in fluid communication through the first and second radial holes and the fluid pipe, thereby reducing the temperature of the working gas in the first chamber, and thereby increasing the temperature of the working gas in the second chamber, which results in an expansion stroke of the second pneumatic cylinder, continued rotation of the second flywheel and the transmission axle, and further rotation of the first flywheel to result in the compression stroke of the first pneumatic cylinder.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

In the method for generating kinetic energy from thermal energy according to this invention, thermal energy is applied to a cylinder body of a first pneumatic cylinder to result in an expansion stroke of the first pneumatic cylinder and in rotation of a flywheel assembly that is coupled to the first pneumatic cylinder. A second pneumatic cylinder is coupled to the flywheel assembly such that the expansion stroke of the first pneumatic cylinder results in a compression stroke of the second pneumatic cylinder. The first and second pneumatic cylinders are fluidly intercommunicated at the instant the first pneumatic cylinder reaches the end of the expansion stroke, thereby reducing the temperature of working gas in the first pneumatic cylinder, and thereby increasing the temperature of working gas in the second pneumatic cylinder to result in an expansion stroke of the second pneumatic cylinder, continued rotation of the flywheel assembly, and in a compression stroke of the first pneumatic cylinder.

Figure 1:
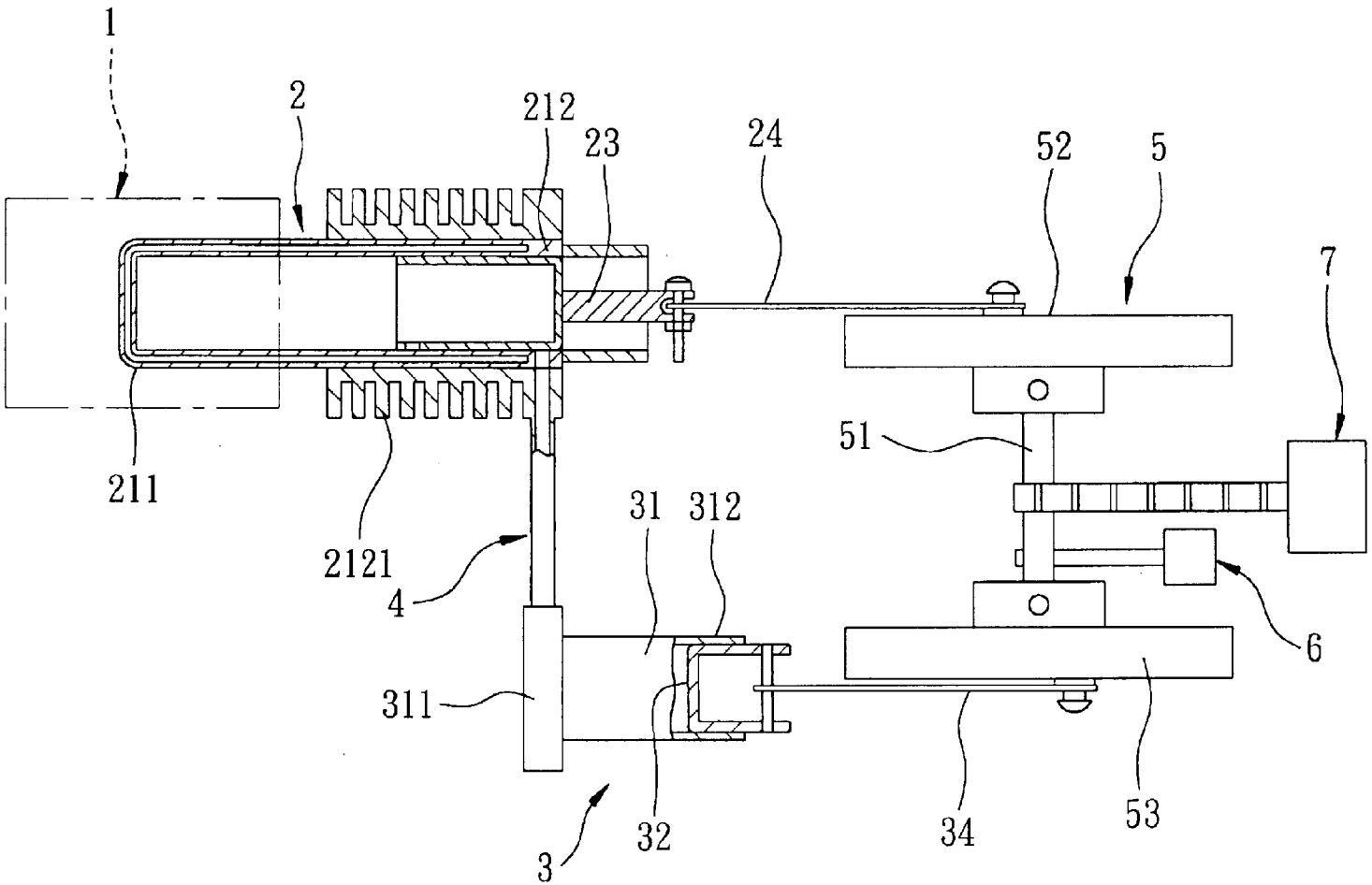
FIG. 1 is a partly sectional, schematic top view showing a preferred embodiment of an apparatus for generating kinetic energy from thermal energy according to the present invention.

Referring to FIG. 1, the preferred embodiment of an apparatus for generating kinetic energy from thermal energy according to the present invention is shown to comprise a thermal energy source 1, a first pneumatic cylinder 2, a second pneumatic cylinder 3, a fluid pipe 4, a flywheel assembly 5, a starting device 6, and an electric generator 7.

The thermal energy source 1 can be a solar energy collector, a geothermal energy conductor, or a biomass incinerator. The solar energy collector may be of the type disclosed in U.S. Pat. No. 6,301,893, which is provided with an automatic tracking ability to maintain constant alignment with the sun. Light energy collected by the solar energy collector is directed to one end of a thermal superconductor device (not shown). The other end of the thermal superconductor device is placed immovably on the first pneumatic cylinder 2. The geothermal energy conductor may be of the type disclosed in U.S. Pat. No. 6,301,893, which teaches a thermal superconductor having one end buried in the ground. The other end of the thermal superconductor is connected to the first pneumatic cylinder 2. When a biomass incinerator is used as the thermal energy source 1, organic materials can serve as fuel for the same. Examples of suitable organic materials include dried animal waste, garbage, aquatic plants, and biogas.

Figure 2:
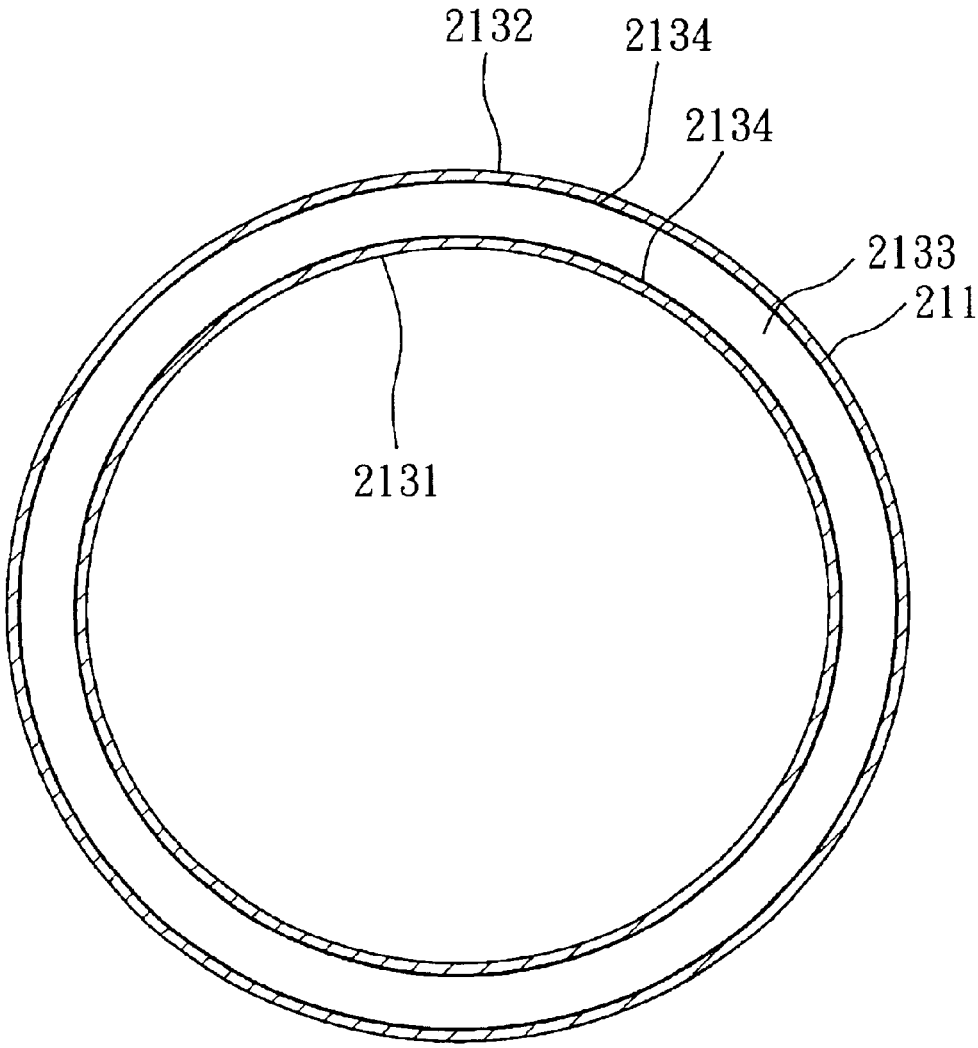
FIG. 2 is a schematic cross-sectional view of a heating section of a first pneumatic cylinder of the apparatus of the preferred embodiment.
Figure 3:
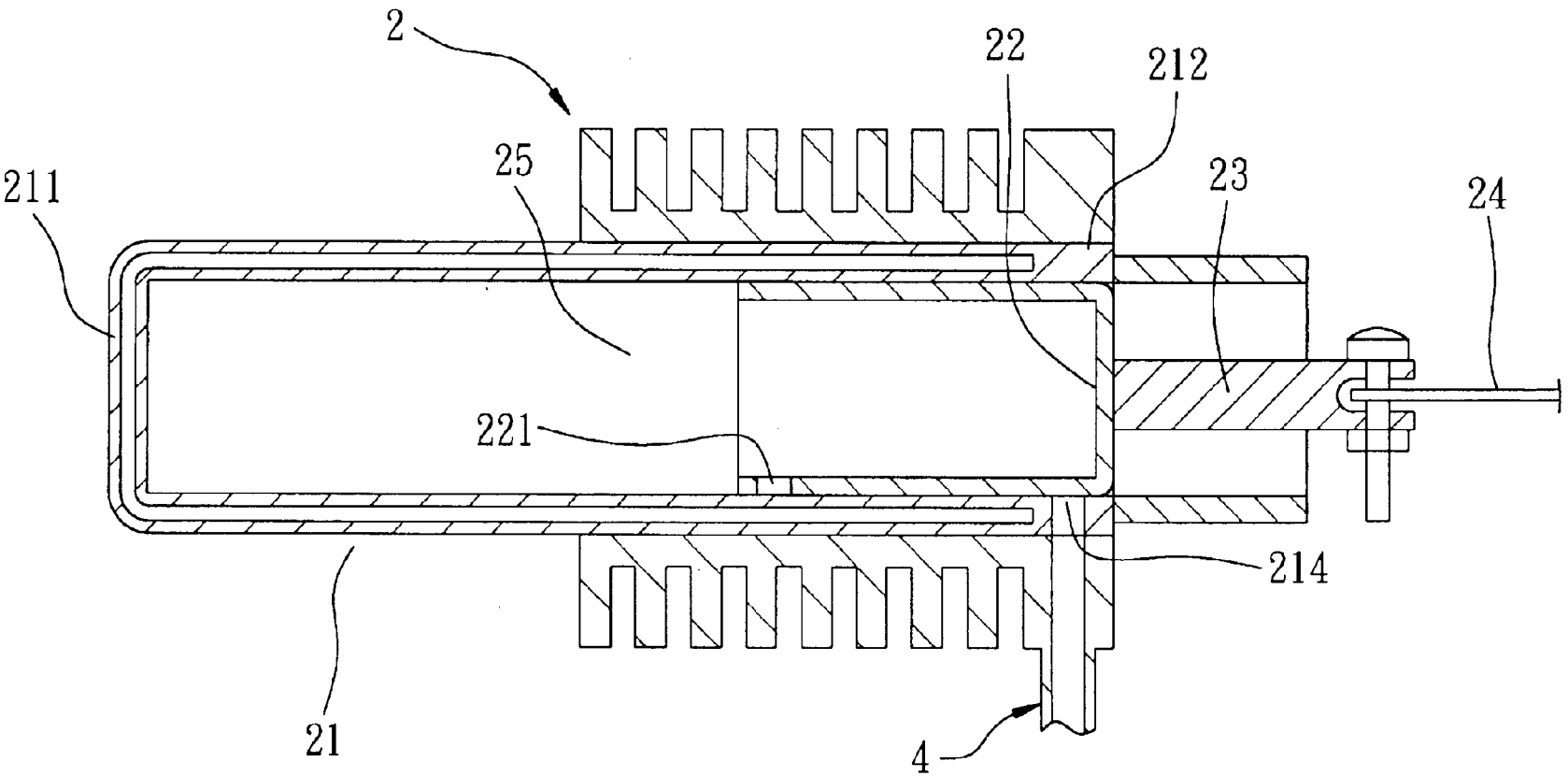
FIG. 3 is a schematic cross-sectional view of the first pneumatic cylinder.

With further reference to FIGS. 2 and 3, the first pneumatic cylinder 2 includes a first cylinder body 21, a first piston 22 and a first piston rod 23.

The first cylinder body 21 has a heating section 211 to be heated by the thermal energy source 1, and an operating section 212 opposite to the heating section 211 and formed with a first radial hole 214. The operating section 212 is formed with heat-dissipating fins 2121.

The heating section 211 includes an inner cylinder wall 2131 and an outer cylinder wall 2132 that is connected to and that cooperates with the inner cylinder wall 2131 to form an annular space 2133. Each of the inner and outer cylinder walls 2131, 2132 is made of a thermally conductive material, such as aluminum, copper, or a metal alloy, or a material which exhibits excellent heat conducting characteristics. Moreover, each of the inner and outer cylinder walls 2131, 2132 is formed with a lining 2134, which is made of a thermal superconductor material that has a relatively large coefficient of thermal conductivity, in the annular space 2133. The linings 2134 are preferably formed by a vacuum deposition process. In actual practice, the surfaces of the cylinder walls 2131, 2132 are first passivated, washed and dried. The thermal superconductor material is then injected or filled into the annular space 2133, which is then vacuumed and sealed so as to form the linings 2134 on the cylinder walls 2131, 2132.

The first piston 22 is disposed in the first cylinder body 2, cooperates with the heating section 211 of the first cylinder body 2 to form a first chamber 25 that is filled with a working gas, and is movable along the length of the first cylinder body 2. In the preferred embodiment, the first piston 22 includes a cup-shaped member formed with a cavity that faces toward the heating section 211 and that is in fluid communication with the first chamber 25. The cup-shaped member is further formed with a radial through-hole 221.

The first piston rod 23 is connected to the first piston 22, and extends out of the first cylinder body 21 through the operating section 212.

Figure 4:
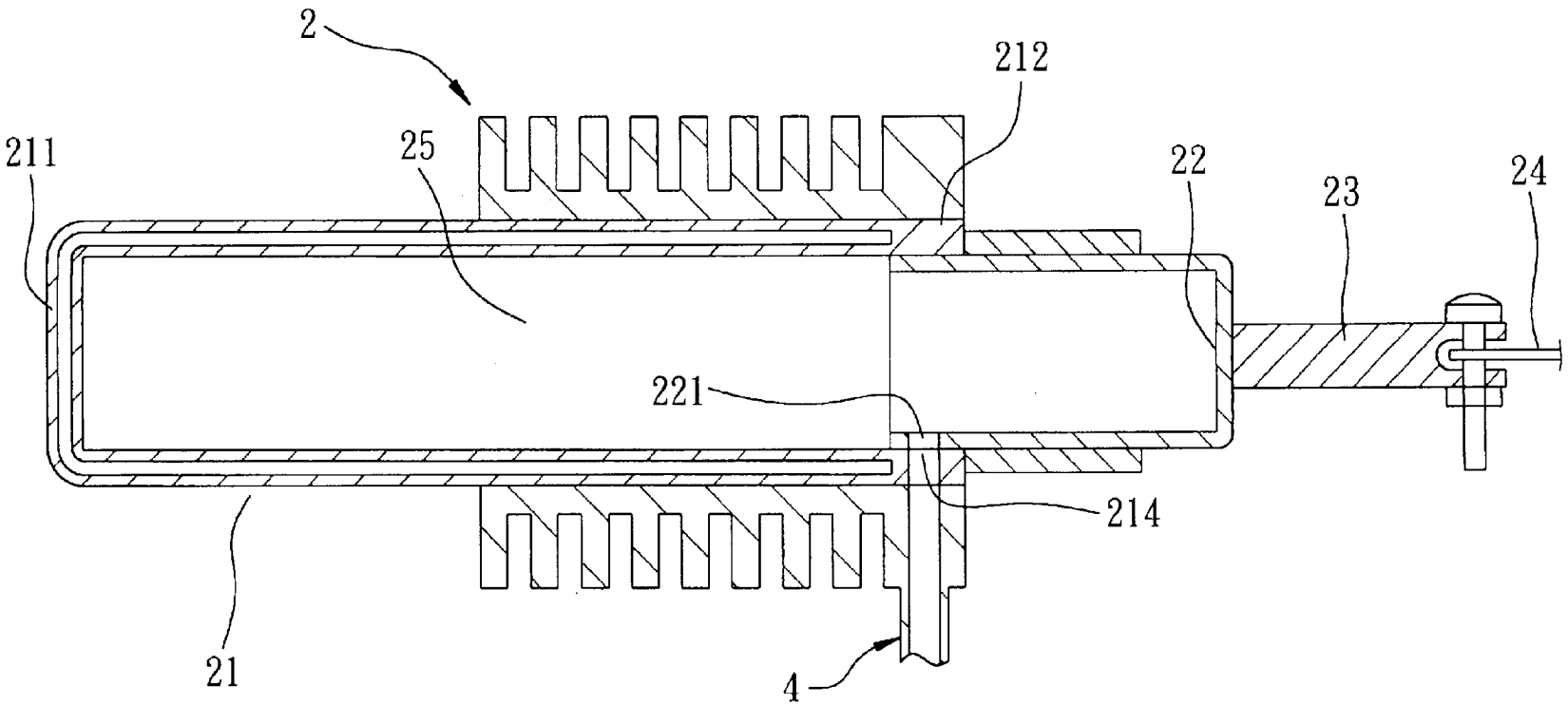
FIG. 4 is another schematic cross-sectional view to illustrate the first pneumatic cylinder at the end of an expansion stroke.

In operation, the first piston 22 seals the first radial hole 214 during a compression stroke of the first pneumatic cylinder 2 (as shown in FIG. 3), and unseals the first radial hole 214 at the end of an expansion stroke of the first pneumatic cylinder 2 due to alignment between the radial through-hole 221 and the first radial hole 214 (as shown in FIG. 4).

Figure 5:
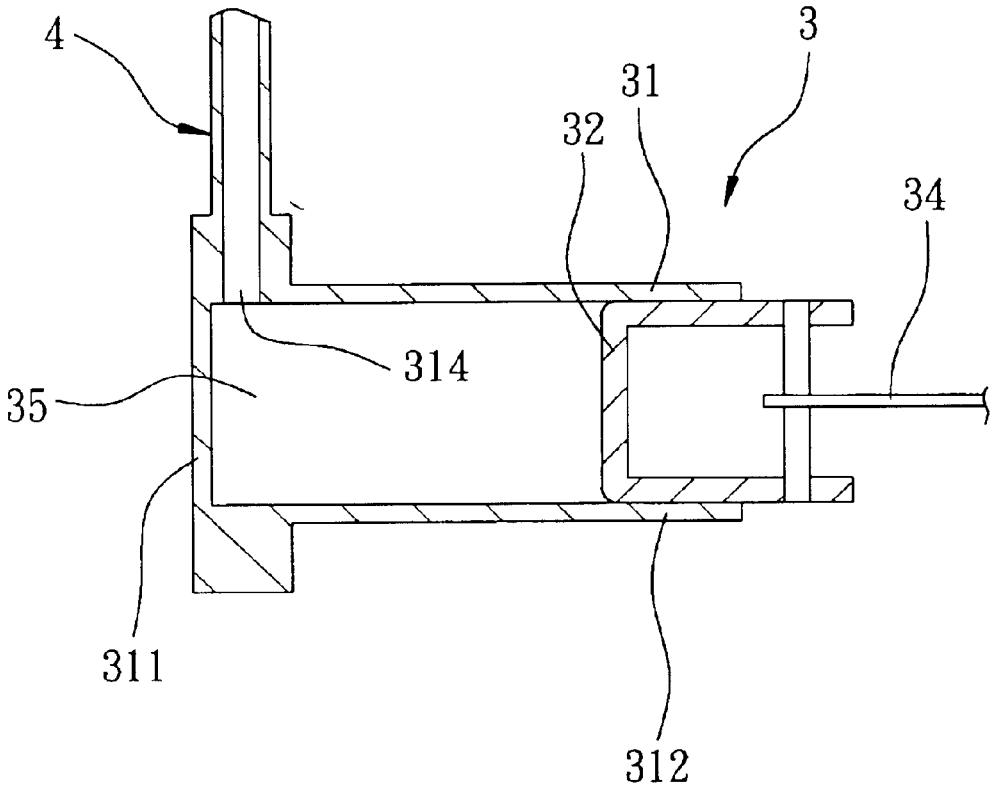
FIG. 5 is a schematic cross-sectional view of a second pneumatic cylinder of the apparatus of the preferred embodiment.

Referring to FIGS. 1 and 5, the second pneumatic cylinder 3 includes a second cylinder body 31 parallel to the first cylinder body 21, and a second piston 32.

The second cylinder body 31 has a chamber-connecting section 311 formed with a second radial hole 314, and an operating section 312 opposite to the chamber-connecting section 311.

The second piston 32 is disposed in the second cylinder body 31, and cooperates with the chamber-connecting section 311 to form a second chamber 35 that is filled with the working gas. The second piston 32 is movable along the length of the second cylinder body 31.

The fluid pipe 4 has opposite ends connected to the first and second cylinder bodies 21, 31 at the first and second radial holes 214, 314, respectively, as best shown in FIGS. 3 and 5.

Referring once again to FIG. 1, the flywheel assembly 5 includes a transmission axle 51 having a first axle end and a second axle end, a first flywheel 52 secured on the first axle end, a first connecting rod 24 that has a first end pivoted eccentrically on the first flywheel 52 at a first pivot point and that has a second end connected pivotally to the first piston rod 23, a second flywheel 53 secured on the second axle end, and a second connecting rod 34 that has a first end pivoted eccentrically on the second flywheel 53 at a second pivot point that is spaced apart angularly from the first pivot point with respect to the transmission axle 51 and that has a second end connected pivotally to the second piston 32 and that is extendible into and out of the second cylinder body 31 through the operating section 312 of the second cylinder body 31 and in a same direction as the first piston rod 23 and the first connecting rod 24.

The starting device 6 is coupled to the transmission axle 51 of the flywheel assembly 5, and is operable so as to drive initial rotation of the flywheel assembly 5.

The electric generator 7 is coupled to the transmission axle 51 of the flywheel assembly 5, and is operable so as to generate electric power from rotation of the transmission axle 51 in a conventional manner.

Preferably, the working gas in the first and second chambers 25, 35 of the first and second cylinder bodies 21, 31 is an inert gas. Inert gases have characteristics, such as little activity, good stability and high expansion coefficient. Accordingly, the working gas can expand quickly when subjected to heat, and can contract quickly when cooled. The fins 2121 on the operating section 212 of the first pneumatic cylinder 2 accelerate cooling of the working gas in the first chamber 25 of the first pneumatic cylinder 2 at the end of the expansion stroke of the first pneumatic cylinder 2.

Figure 6A:
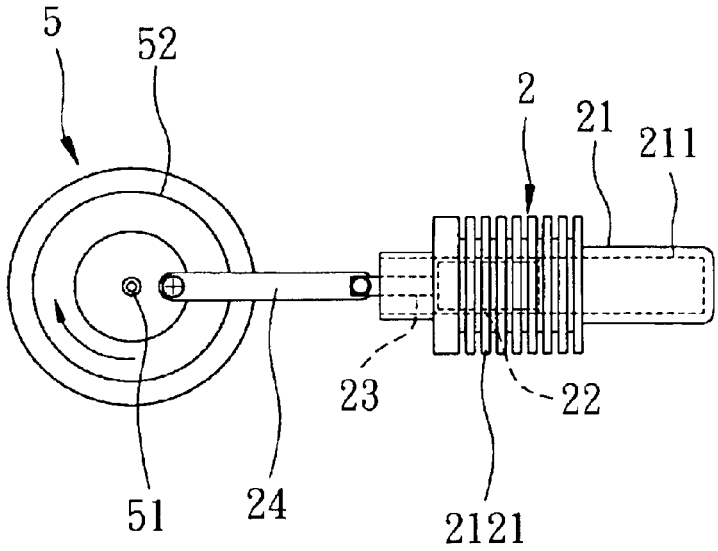
FIG. 6A is a schematic side view showing the first pneumatic cylinder and a first flywheel during an initial operating state of the apparatus of the preferred embodiment.
Figure 6B:
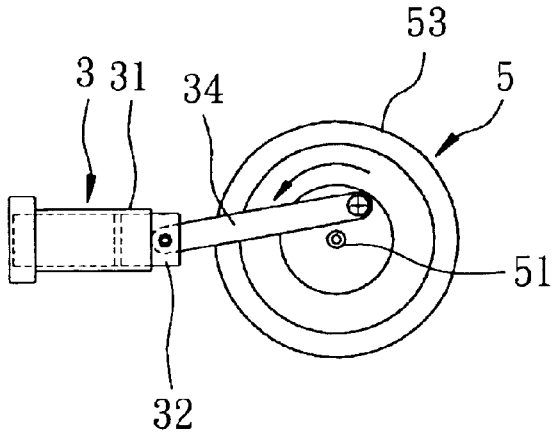
FIG. 6B is a schematic side view showing the second pneumatic cylinder and a second flywheel during the initial operating state of the apparatus of the preferred embodiment.

In operation, referring to FIGS. 1, 6A and 6B, after the starting device 6 drives initial rotation of the flywheel assembly 5, the thermal energy applied by the thermal energy source 1 to the heating section 211 of the first cylinder body 21 of the first pneumatic cylinder 2 will result in an expansion stroke of the first pneumatic cylinder 2, i.e., the working gas in the first chamber 25 of the first pneumatic cylinder 2 expands. Initially, the first piston 22 of the first pneumatic cylinder 2 is disposed at a position closest to the heating section 211 (see FIG. 6A), while the second piston 32 is disposed at a midpoint position in the second pneumatic cylinder 3 (see FIG. 6B). The expansion of the working gas in the first cylinder body 21 will push the first piston 22 away from the heating section 211 so as to drive rotation of the first flywheel 52 and the transmission axle 51 of the flywheel assembly 5 through the first piston rod 23 and the first connecting rod 24. Since the second flywheel 53 rotates with the transmission axle 51, the second connecting rod 34 pushes the second piston 32 toward the chamber-connecting section 311 so as to compress the working gas in the second cylinder body 31, thereby resulting in a compression stroke of the second pneumatic cylinder 3.

Figure 7A:
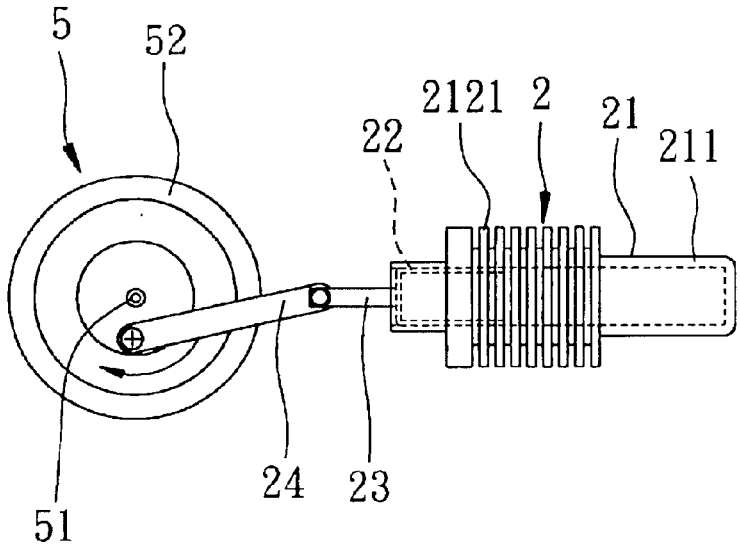
FIG. 7A is a schematic side view showing the first pneumatic cylinder when at a midpoint extended state during operation of the apparatus of the preferred embodiment.
Figure 7B:
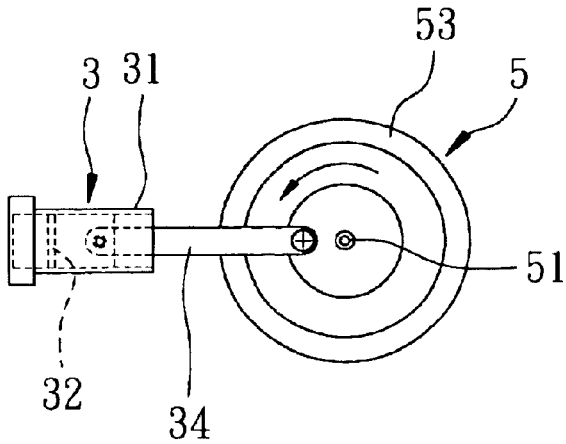
FIG. 7B is a schematic side view showing the second pneumatic cylinder when at the end of a compression stroke.
Figure 8A:
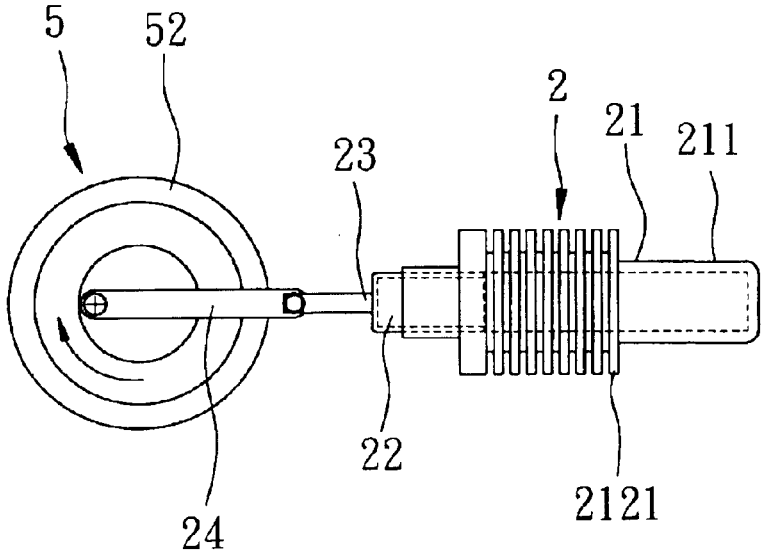
FIG. 8A is a schematic side view showing the first pneumatic cylinder when at the end of an expansion stroke.
Figure 8B:
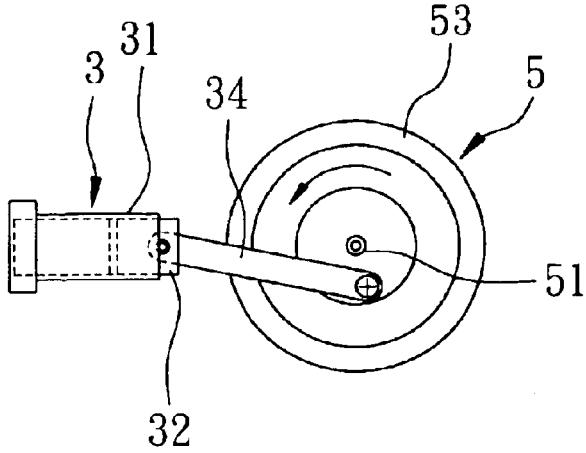
FIG. 8B is a schematic side view showing the second pneumatic cylinder when at a midpoint extended state during operation of the apparatus of the preferred embodiment.

Thereafter, when the first piston 22 in the first cylinder body 21 reaches a midpoint position relative to the first cylinder body 21 (see FIG. 7A), the second piston 32 in the second cylinder body 31 will reach a position closest to the chamber-connecting section 311 (see FIG. 7B; The chamber-connecting section 311 is illustrated in FIG. 5). Subsequently, when the first piston 22 in the first cylinder body 21 reaches a position farthest from the heating section 211 (see FIG. 8A, that is, at the end of an expansion stroke of the first pneumatic cylinder 2), the first radial hole 214 is registered with the radial through hole 221 such that the first and second chambers 25, 35 in the first and second pneumatic cylinders 2, 3 are intercommunicated fluidly through the fluid pipe 4, thereby reducing the temperature of the working gas in the first pneumatic cylinder 2 and thereby increasing the temperature of the working gas in the second pneumatic cylinder 3, which results in an expansion stroke of the second pneumatic cylinder 3 (see FIG. 8B), continued rotation of the second flywheel 53 and the transmission axle 51, and further rotation of the first flywheel 52 to result in the compression stroke of the first pneumatic cylinder 2.

Figure 9A:
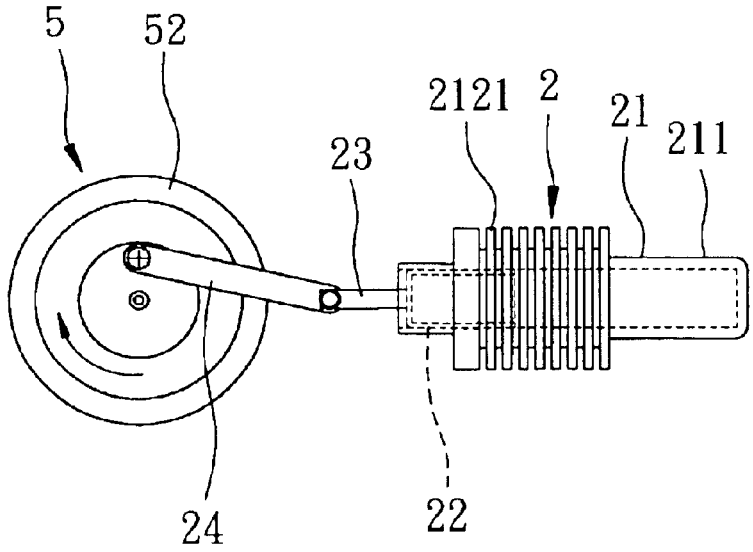
FIG. 9A is a schematic side view showing the first pneumatic cylinder when once again disposed at a midpoint extended state during operation of the apparatus of the preferred embodiment.
Figure 9B:
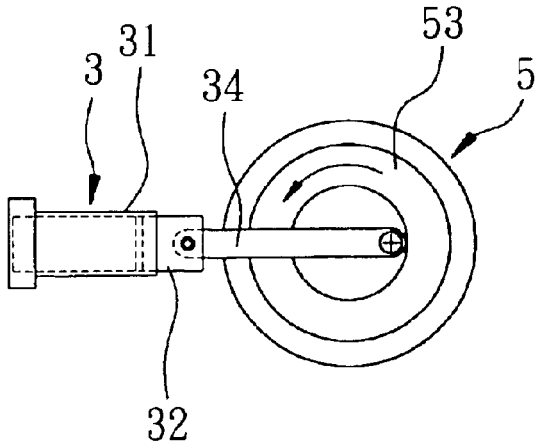
FIG. 9B is a schematic side view showing the second pneumatic cylinder when at the end of an expansion stroke.

Afterwards, when the first piston 22 in the first cylinder body 21 is once again disposed at the midpoint position relative to the first cylinder body 21 (see FIG. 9A), the second piston 32 in the second cylinder body 31 will reach a farthest position relative to the chamber-connecting section 311 (see FIGS. 5 and 9B). By virtue of inertial forces, the various moving components of the apparatus will be subsequently restored to the initial positions shown in FIGS. 6A and 6B for conducting another cycle of operation. Therefore, the reciprocating actions of the first and second pneumatic cylinders 2, 3 result in continuous rotation of the flywheel assembly 5 to generate kinetic energy from thermal energy, and through the electric generator 7, to convert kinetic energy into electrical energy.

In summary, this invention provides an alternative means of generating kinetic energy that meets the requirement of environmental protection. Furthermore, the apparatus of this invention can be manufactured in small scale and can be applied to many instances, including the supply of small amounts of electrical energy when implemented with the electric generator 7. The thermal energy source is conveniently available, and the efficiency of energy conversion is also high.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. An apparatus for generating kinetic energy from thermal energy, comprising:

a thermal energy source;

a first pneumatic cylinder including a first cylinder body having a heating section to be heated by said thermal energy source, and an operating section opposite to said heating section and formed with a first radial hole, a first piston disposed in said first cylinder body and cooperating with said heating section of said first cylinder body to form a first chamber that is filled with a working gas, said first piston being movable along length of said first cylinder body, and a first piston rod connected to said first piston and extending out of said first cylinder body through said operating section, said first piston sealing said first radial hole during a compression stroke of said first pneumatic cylinder, and unsealing said first radial hole at the end of an expansion stroke of said first pneumatic cylinder;

a second pneumatic cylinder including a second cylinder body parallel to said first cylinder body, said second cylinder body having a chamber-connecting section formed with a second radial hole, and an operating section opposite to said chamber-connecting section, and a second piston disposed in said second cylinder body and cooperating with said chamber-connecting section to form a second chamber that is filled with the working gas, said second piston being movable along length of said second cylinder body;

a fluid pipe having opposite ends connected to said first and second cylinder bodies at said first and second radial holes, respectively; and a flywheel assembly including a transmission axle having a first axle end and a second axle end, a first flywheel secured on said first axle end, a first connecting rod having a first end pivoted eccentrically on said first flywheel at a first pivot point, and a second end connected pivotally to said first piston rod, a second flywheel secured on said second axle end, and a second connecting rod having a first end pivoted eccentrically on said second flywheel at a second pivot point that is spaced apart angularly from the first pivot point with respect to said transmission axle, and a second end connected pivotally to said second piston and extendible into and out of said second cylinder body through said operating section of said second cylinder body and in a same direction as said first piston rod and said first connecting rod;

wherein the thermal energy applied by said thermal energy source to said heating section of said first cylinder body initially results in the expansion stroke of said first pneumatic cylinder, thereby resulting in rotation of said first flywheel and said transmission axle, and in rotation of said second flywheel to result in a compression stroke of said second pneumatic cylinder;

wherein, when said first piston reaches the end of the expansion stroke of said first pneumatic cylinder, said first and second chambers are in fluid communication through said first and second radial holes and said fluid pipe, thereby reducing the temperature of the working gas in said first chamber and increasing the temperature of the working gas in said second chamber, which results in an expansion stroke of said second pneumatic cylinder, continued rotation of said second flywheel and said transmission axle, and further rotation of said first flywheel to result in the compression stroke of said first pneumatic cylinder.

2. The apparatus of claim 1, further comprising a starting device coupled to said transmission axle of said flywheel assembly and operable so as to drive initial rotation of said flywheel assembly.

3. The apparatus of claim 1, further comprising an electric generator coupled to said transmission axle of said flywheel assembly and operable so as to generate electric power from rotation of said transmission axle.

4. A The apparatus of claim 1, wherein the working gas is an inert gas.

5. The apparatus of claim 1, wherein said first cylinder body is made of a thermally conductive material.

6. The apparatus of claim 5, wherein said heating section of said first cylinder body includes an inner cylinder wall and an outer cylinder wall that is connected to and that cooperates with said inner cylinder wall to form an annular space.

7. The apparatus of claim 6, wherein each of said inner and outer cylinder walls is formed with a lining, which is made of a thermal superconductor material, in said annular space.

8. The apparatus of claim 5, wherein said operating section of said first cylinder body is formed with heat-dissipating fins.

9. The apparatus of claim 1, wherein said thermal energy source is one of a solar energy collector, a geothermal energy conductor, and a biomass incinerator.

10. The apparatus of claim 1, wherein said first piston includes a cup-shaped member formed with a cavity that faces toward said heating section and that is in fluid communication with said first chamber, said cup-shaped member being further formed with a radial through hole that is registered with said first radial hole at the end of the expansion stroke of said first pneumatic cylinder.

* * * * *